US006367282B1

(12) United States Patent
Chu

(10) Patent No.: US 6,367,282 B1
(45) Date of Patent: Apr. 9, 2002

(54) DESICCATOR CONTAINER FOR AUTOMOBILE AIR CONDITIONER

(76) Inventor: Chun-Chung Chu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/803,116

(22) Filed: Mar. 12, 2001

(51) Int. Cl.[7] ..... F25B 43/00
(52) U.S. Cl. ..... 62/474; 62/503
(58) Field of Search ..... 62/474, 503; 220/661

(56) References Cited

U.S. PATENT DOCUMENTS 4,939,904 A * 7/1990 Carlisle, Jr. ..... 62/503
5,038,578 A * 8/1991 Manz et al. ..... 62/474
5,201,195 A * 4/1993 Gavlak et al. ..... 62/474
5,479,790 A * 1/1996 Bottum, Jr. et al. ..... 62/503
5,515,696 A * 5/1996 Hitchison ..... 62/474
6,170,288 B1 * 1/2001 Incorvia ..... 62/474
6,178,772 B1 * 1/2001 Incorvia ..... 62/503

* cited by examiner

*Primary Examiner*—William E. Tapolcai

(57) ABSTRACT

A desiccator container is installed in a refrigerant pipe of an automobile air conditioner for absorbing water contained in refrigerant. The container comprises an inlet connector, an outlet connector, a test connector, a pair of first bolts, a pair of second bolts smaller than the first bolts, four first threaded holes, and three second threaded holes smaller than the first threaded holes. This can increase the adaptability of the desiccator container, thereby reducing the manufacturing and maintenance costs.

2 Claims, 6 Drawing Sheets

DESICCATOR CONTAINER FOR AUTOMOBILE AIR CONDITIONER

BACKGROUND OF THE INVENTION

1. Field of the Invention

The present invention relates to automobile air conditioner and more particularly to a desiccator container for automobile air conditioner with improved adaptability.

2. Description of the Prior Art

Air conditioning is important in providing a comfortable environment for passenger(s) in an automobile while driving. This is especially true in a high temperature outdoor environment. Conventionally, it is impossible to completely prevent water from entering the air conditioning system of an automobile. The problem of refrigerant pipes of air conditioning system containing water is that the heat exchange efficiency of the system is lowered due to the mixing of refrigerant and water. Hence, the performance of automobile air conditioner is degraded and the load of compressor is increased. As a result, the consumption of energy (e.g., fuel) is significantly increased. An improvement to above problem is the installation of a desiccator container in the air conditioning system for absorbing water contained in refrigerant. It is found that there are a variety of desiccator containers commercially available. For example, a conventional cylindrical desiccator container 7 is shown in FIG. 1 wherein an inlet connector 71 at one end of an inlet line 711 and an outlet connector 72 at one end of an outlet line 721 are oppositely provided on the circumferential surface of desiccator container 7 and a test connector 73 is provided between inlet connector 71 and outlet connector 72. Desiccator container 7 is provided in a predetermined position of refrigerant pipe such that water contained in refrigerant may be absorbed by the container 7 when refrigerant is circulated through the refrigerant pipe. A probe of a test device (not shown) may be coupled to test connector 73 for measuring the remained amount of desiccator in order to determine whether it is necessary to replace the current desiccator container 7 with a new one. Another conventional cylindrical desiccator container 7 is shown in FIG. 2 wherein outlet connector 74 and test connector 73 are oppositely provided on the circumferential surface of desiccator container 7 and inlet connector 71 is equally spaced apart from outlet connector 74 and test connector 73. Still another conventional cylindrical desiccator container 7 is shown in FIG. 3 wherein all inlet connector 71, outlet connector 72, and test connector 731 are provided on the top of desiccator container 7. In view of above, it is impossible to replace one type of desiccator container 7 (e.g., the one shown in FIG. 1) with another type of desiccator container 7 (e.g., the one shown in FIG. 2) if the former does not function normally. This may increase the manufacturing and maintenance costs of desiccator containers which are inevitably borne on automobile component manufactures and consumers accordingly.

SUMMARY OF THE INVENTION

It is an object of the present invention to provide a desiccator container provided in a predetermined position of a refrigerant pipe of an automobile air conditioner for absorbing water contained in refrigerant circulated in the refrigerant pipe, the desiccator container comprising an inlet connector, an outlet connector, a test connector, a pair of first bolts, a pair of second bolts smaller than the first bolts, four first threaded holes, and three second threaded holes smaller than the first threaded holes. This can increase the adaptability of the desiccator container, thereby reducing the manufacturing and maintenance costs.

The above and other objects, features and advantages of the present invention will become apparent from the following detailed description taken with the accompanying drawings.

DETAILED DESCRIPTION OF THE PREFERRED EMBODIMENTS

Figure 1:
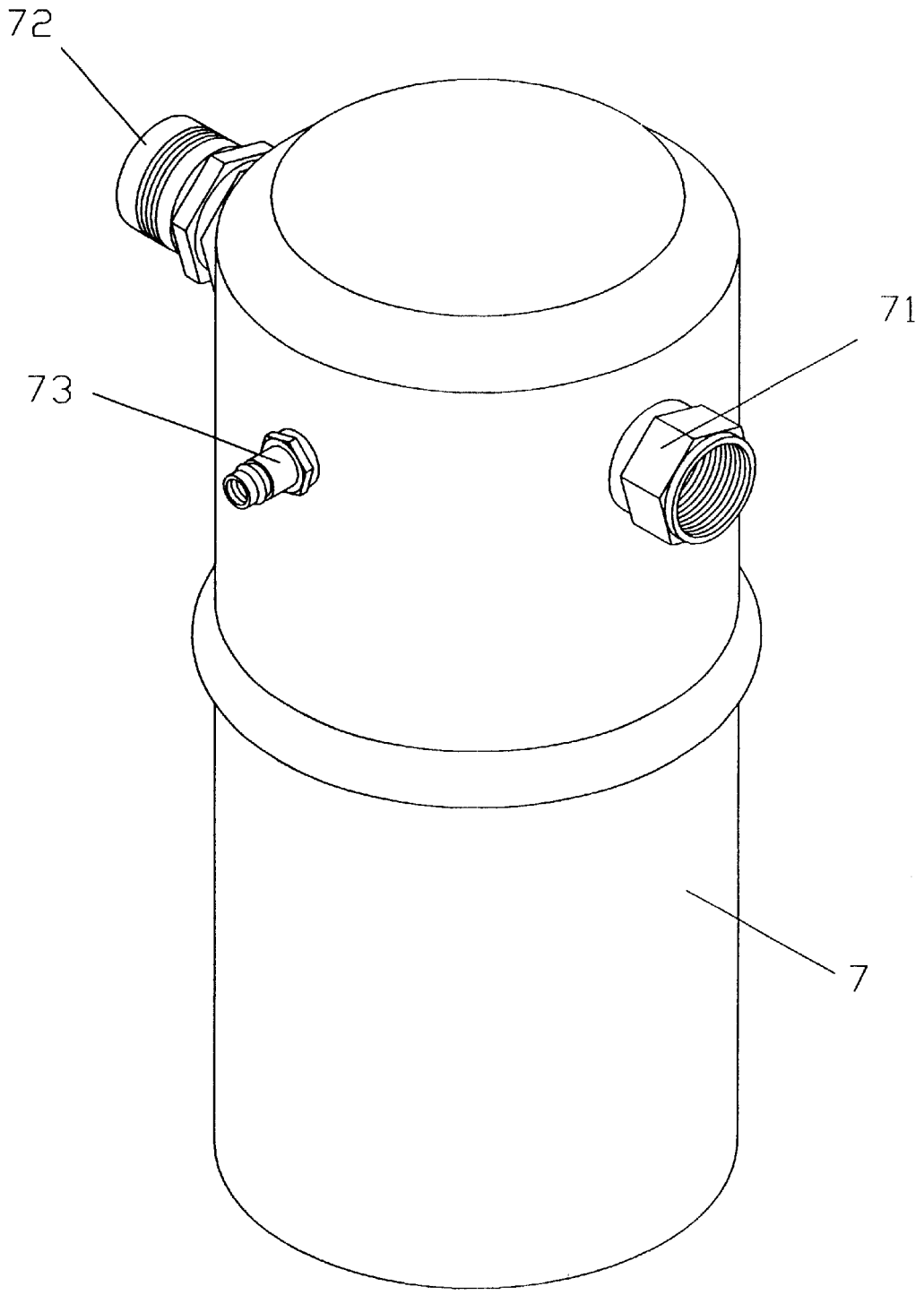
FIG.1 Prior Art
FIG. 1 is a perspective view of a conventional desiccator container for automobile air conditioner.
Figure 2:
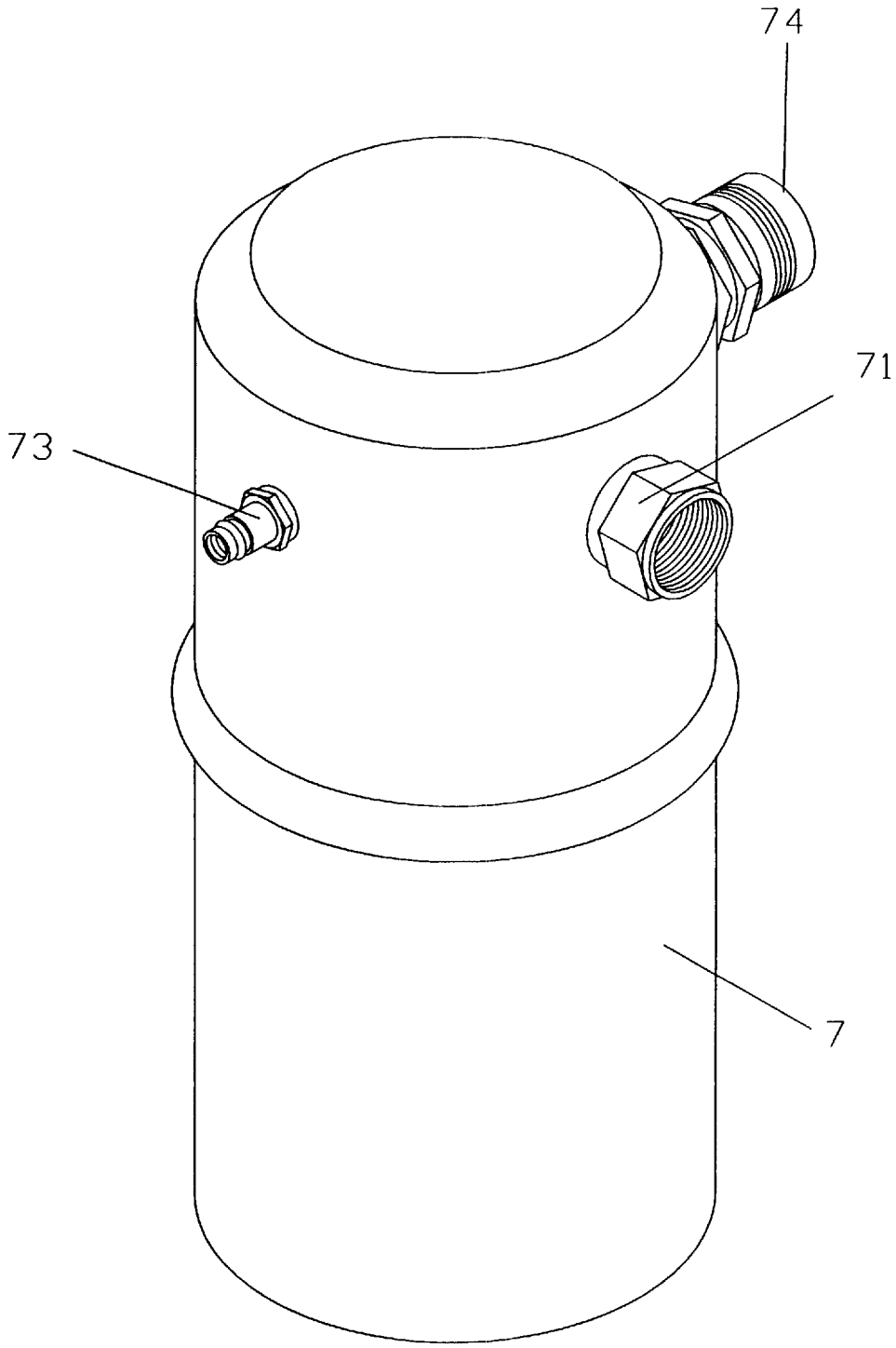
FIG.2 Prior Art
FIG. 2 is a perspective view of another conventional desiccator container for automobile air conditioner.
Figure 3:
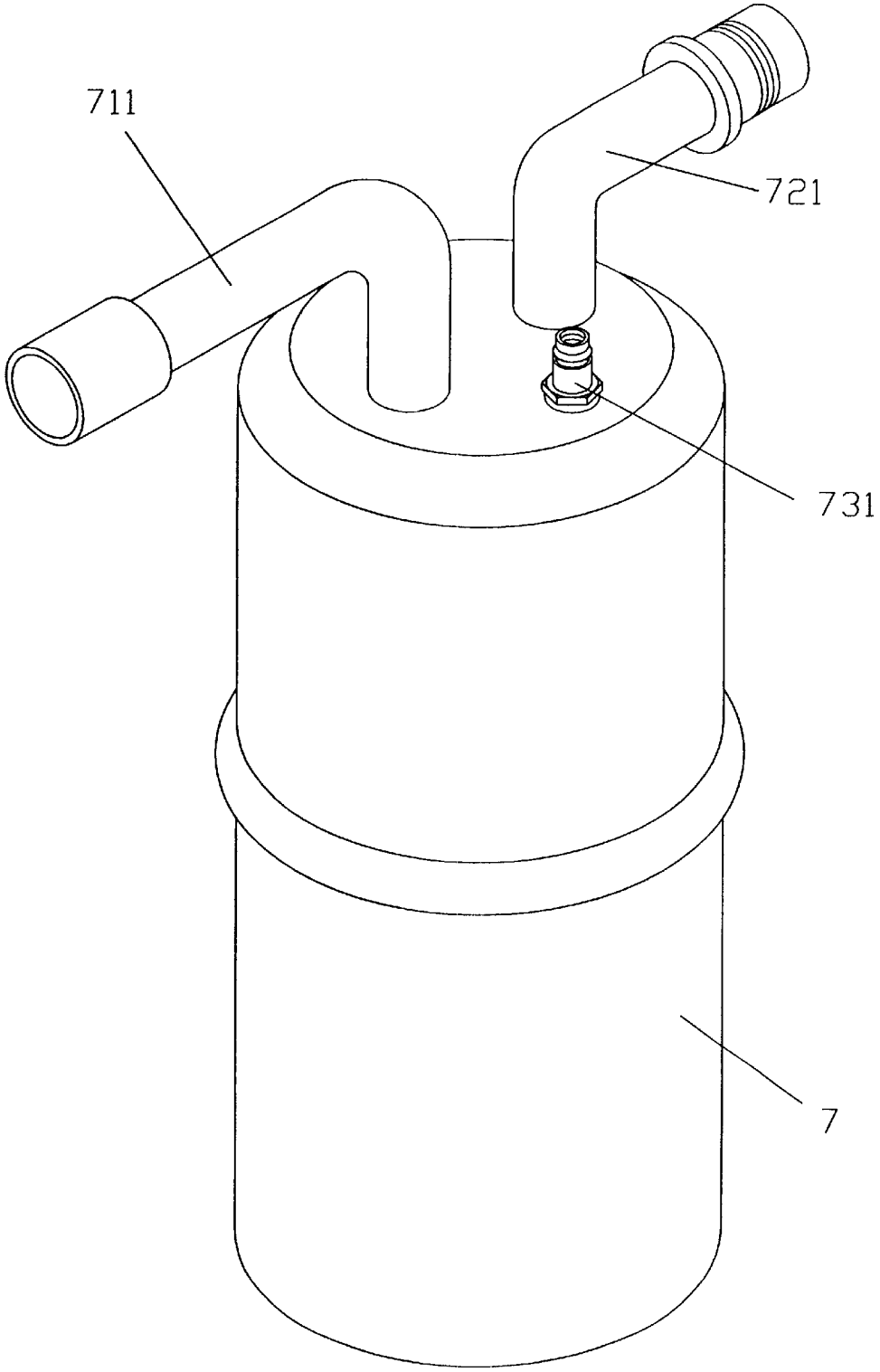
FIG.3 Prior Art
FIG. 3 is a perspective view of still another conventional desiccator container for automobile air conditioner.
Figure 4:
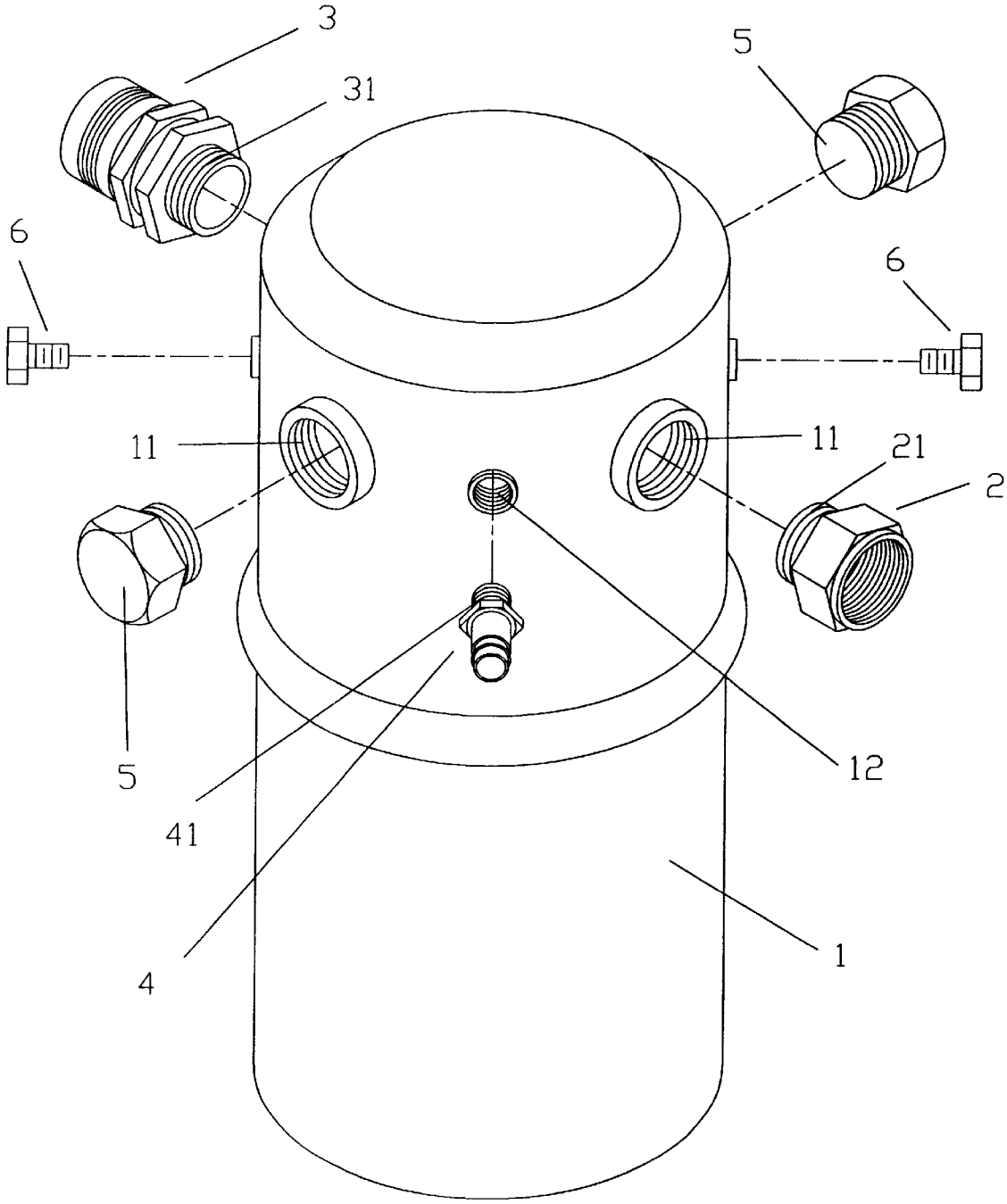
FIG. 4 is an exploded perspective view of a preferred embodiment of desiccator container for automobile air conditioner according to the invention.
Figure 5:
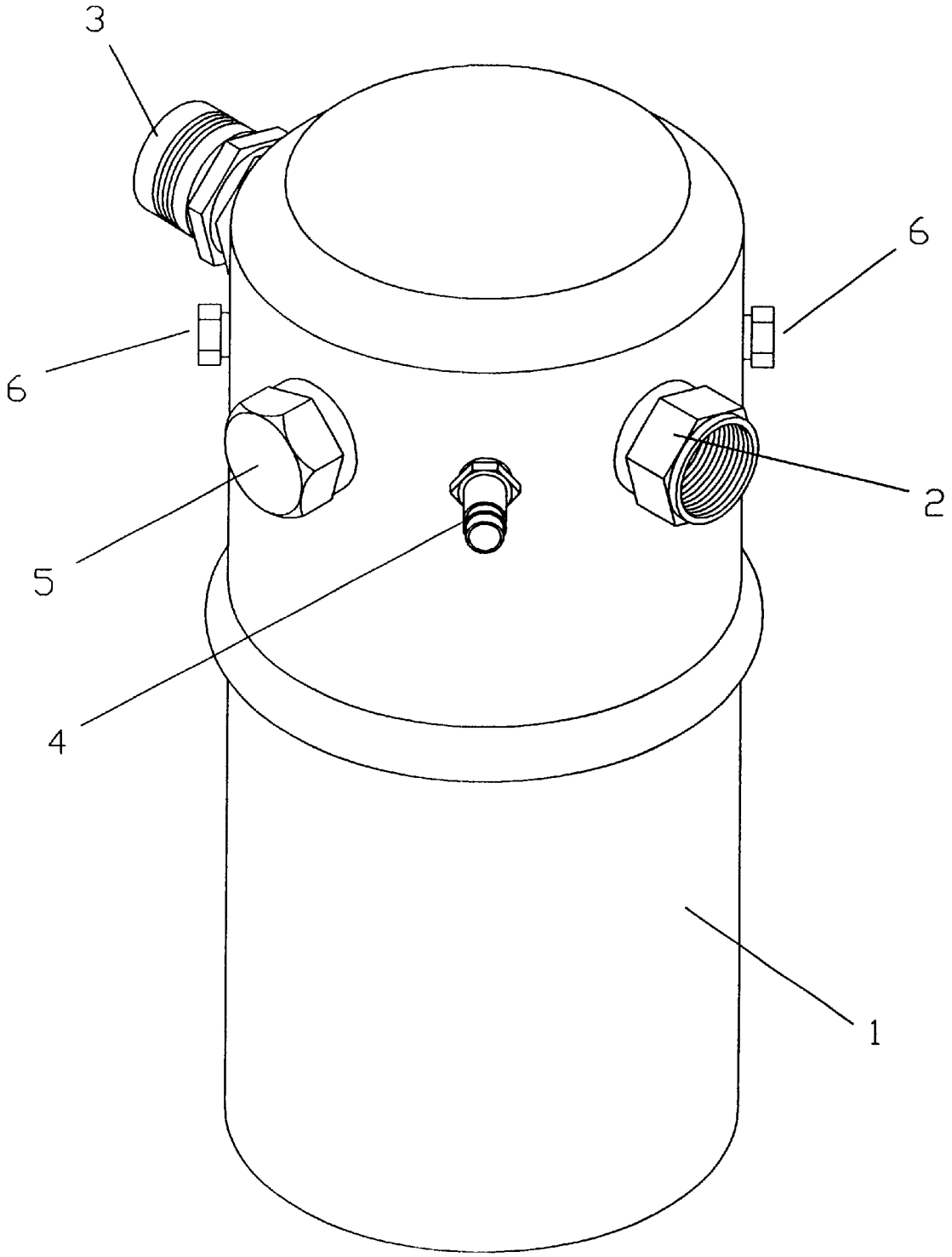
FIG. 5 is a perspective view of the assembled FIG. 4 desiccator container.

Referring to FIGS. 4 and 5, there is shown a cylindrical desiccator container 1 for automobile air conditioner constructed in accordance with the invention. The desiccator container 1 is installed in a predetermined position of a refrigerant pipe of the air conditioning system of automobile for absorbing water contained in refrigerant. The desiccator container 1 comprises an inlet connector 2, an outlet connector 3, a test connector 4, a pair of first bolts 5, and a pair of second bolts 6 smaller than first bolts 5. On the circumferential surface of the body of desiccator container 1 there are provided four first threaded holes 11 and three second threaded holes 12 smaller than first threaded holes 11. Inlet connector 2 has an outer threaded portion 21 for threadedly securing to first threaded hole 11. Similarly, outlet connector 3 has an outer threaded portion 31 for threadedly securing to first threaded hole 11. Further, first bolts 5 are threadedly secured to first threaded holes 11 and second bolts 6 are threadedly secured to second threaded holes 12 respectively. Furthermore, test connector 4 has an outer threaded portion 41 for threadedly securing to second threaded hole 12. This forms the desiccator container 1 of the invention.

Figure 6:
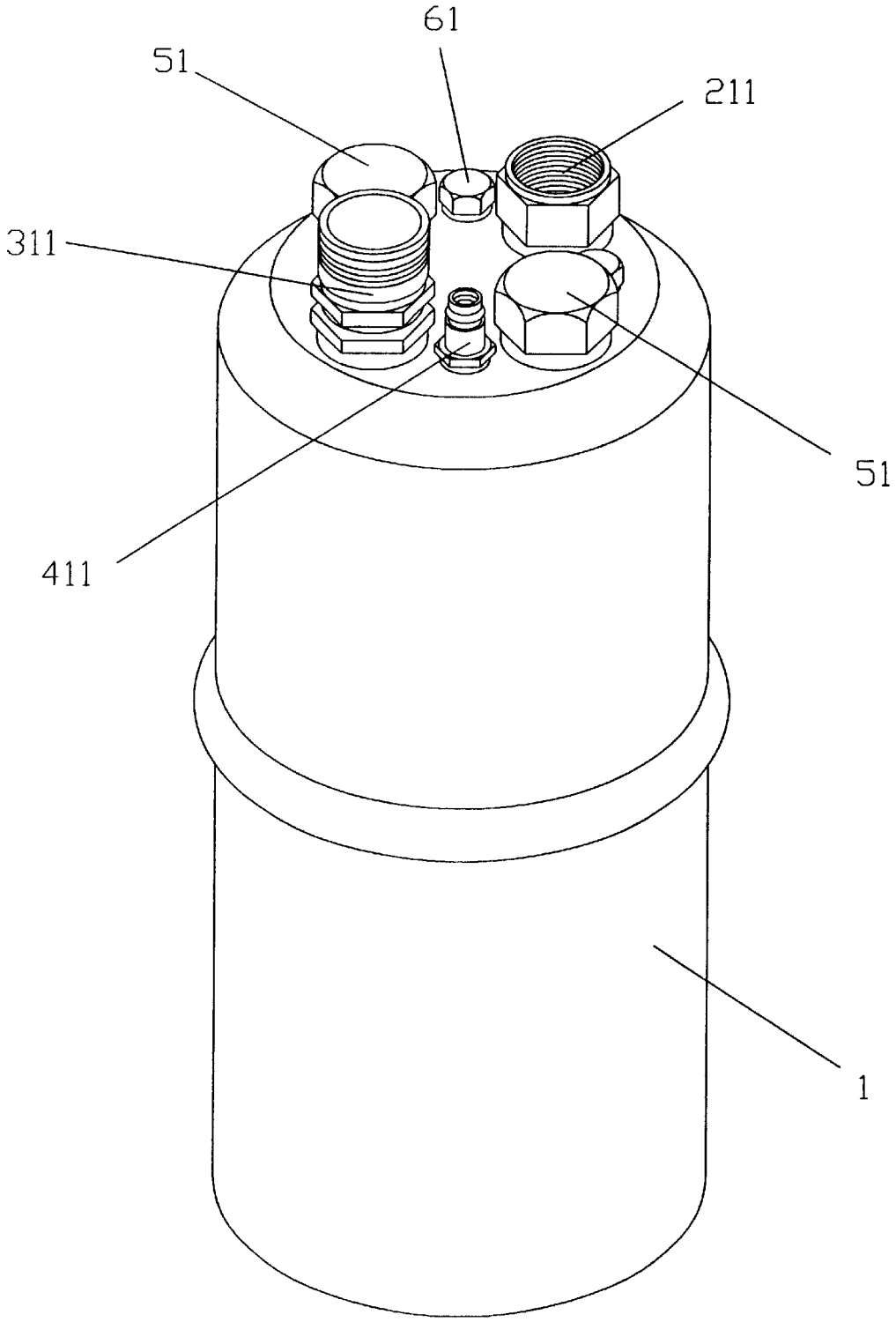
FIG. 6 is a perspective view of another preferred embodiment of desiccator container for automobile air conditioner according to the invention.

Referring to FIG. 6, there is shown another preferred embodiment of desiccator container for automobile air conditioner according to the invention. The difference between this and the previous embodiments is that all inlet connector 211, outlet connector 311, test connector 411, a pair of first bolts 11 (not shown), a pair of second bolts 12 smaller than first bolts 11 (not shown), four first threaded holes 51, and three second threaded holes 61 smaller than first threaded holes 51 are provided on the top of desiccator container 1.

While the invention has been described by means of specific embodiments, numerous modifications and variations could be made thereto by those skilled in the art without departing from the scope and spirit of the invention set forth in the claims.

What is claimed is:

1. A desiccator container provided in a refrigerant pipe of an automobile air conditioner for absorbing water contained in refrigerant circulated in said refrigerant pipe, said desiccator container comprising:

a plurality of first threaded holes;

a plurality of second threaded holes smaller than said first threaded holes;

an inlet connector having an outer threaded portion for threadedly securing to one of said first threaded holes;

an outlet connector having an outer threaded portion for threadedly securing to another of said first threaded holes;

a test connector having an outer threaded portion for threadedly securing to one of said second threaded holes;

a pair of first bolts each threadedly secured to others of said first threaded holes; and a pair of second bolts smaller than said first bolts, each second bolt being threadedly secured to said second threaded hole;

wherein said first threaded holes, said second threaded holes, said inlet connector, said outlet connector, said test connector, said first bolts, and said second bolts are provided on said side surface of said desiccator container.

2. A desiccator container provided in a refrigerant pipe of an automobile air conditioner for absorbing water contained in refrigerant circulated in said refrigerant pipe, said desiccator container comprising:

a plurality of first threaded holes;

a plurality of second threaded holes smaller than said first threaded holes;

an inlet connector having an outer threaded portion for threadedly securing to one of said first threaded holes;

an outlet connector having an outer threaded portion for threadedly securing to another of said first threaded holes;

a test connector having an outer threaded portion for threadedly securing to one of said second threaded holes;

a pair of first bolts each threadedly secured to other of said first threaded holes; and a pair of second bolts smaller than said first bolts, each second bolt being threadedly secured to other of said second threaded holes;

wherein said first threaded holes, said second threaded holes, said inlet connector, said outlet connector, said test connector, said first bolts, and said second bolts are provided on said top surface of said desiccator container.

* * * * *